US008916785B1

(12) United States Patent
Kowalik

(10) Patent No.: US 8,916,785 B1
(45) Date of Patent: Dec. 23, 2014

(54) DOUBLE BREAK DISCONNECT SWITCH

(71) Applicant: Peter M. Kowalik, Trafford, PA (US)

(72) Inventor: Peter M. Kowalik, Trafford, PA (US)

(73) Assignee: Cleaveland/Price Inc., Trafford, PA (US)

( * ) Notice: Subject to any disclaimer, the term of this patent is extended or adjusted under 35 U.S.C. 154(b) by 306 days.

(21) Appl. No.: 13/651,398

(22) Filed: Oct. 13, 2012

(51) Int. Cl.
*H01H 31/30* (2006.01)

(52) U.S. Cl.
USPC ..... 200/48 R; 200/48 A

(58) Field of Classification Search
CPC ..... H01H 31/00; H01H 31/28; H01H 31/283; H01H 31/30
USPC ... 200/48 R, 48 A, 48 P, 48 KB, 48 V, 48 SB, 200/48 CB
See application file for complete search history.

(56) References Cited

U.S. PATENT DOCUMENTS

| | | | | |
|---|---|---|---|---|
| 1,695,868 | A | 12/1928 | Stolz | |
| 2,810,799 | A | 10/1957 | Carmichael et al. | |
| 3,134,865 | A | 5/1964 | Bernatt | |
| 4,078,162 | A | 3/1978 | Turner | |
| 5,483,030 | A * | 1/1996 | Bridges | 200/48 KB |
| 7,091,431 | B1 * | 8/2006 | Arcand et al. | 200/48 R |
| 8,829,372 | B1 * | 9/2014 | Rhein | 200/48 SB |

* cited by examiner

*Primary Examiner* — Amy Cohen Johnson
*Assistant Examiner* — Marina Fishman
(74) *Attorney, Agent, or Firm* — Ronald S. Lombard

(57) ABSTRACT

A double break disconnect switch with a novel drive mechanism that swings the blade open and closed in a conventional manner but the rotation with respect to its longitudinal axis is unique. This mechanism uses a unique cam to rotate the blade about a hinge axis. The blade bearings are of very small diameter to reduce friction and are offset from the blade center of gravity so as to use the blade's weight to keep the blade in disengagement with the break jaw contacts when the switch is opened. The blade bearings are not around the diameter of the blade, the friction does not increase as current rating increases. A camming mechanism is profiled to give maximum rotational torque to the blade as it compresses the contact fingers as the switch closes to its final position.

15 Claims, 7 Drawing Sheets

CLOSED

CLOSED

OPEN

DOUBLE BREAK DISCONNECT SWITCH

BACKGROUND OF THE INVENTION

The invention relates generally to a double break disconnect switch for high voltage applications and, more particularly, to a double break disconnect switch having fixed jaws and a switch blade assembly having a macro swinging movement relative to the jaws and arranged for a rotational movement with respect to its longitudinal axis upon contact with the fixed jaws to effect closing and opening of the switch.

High voltage switches of this type customarily employ round tubular blades which rotate on their long center axis to achieve the contact pressure developing or relieving for opening or closing of the switch. Because of restrictions to movement that may develop because of causes such as ice build up between the fixed jaws and the switch blade assembly or debris large forces are often necessary to initially open or finally close the switch.

Many such switches on the market today, employ arrangements such as a beveled gear approach for rotational movement of the switch blade assembly with respect to its longitudinal axis. Such an arrangement is disclosed in U.S. Pat. No. 2,810,799 issued to Robert D. Carmichael, et al. on Oct. 22, 1957. The Carmichael device uses cooperating gear teeth for rotation of the switch blade about its longitudinal axis. Another switch using a different arrangement for rotation of the switch blade assembly with respect to its longitudinal axis is disclosed in U.S. Pat. No. 3,134,865 issued to Joseph Bernatt on May 26, 1964. The Bernatt device discloses a switch using a pressure member to engage a V-shaped cam which includes circular detents to lock the blade assembly in desired position. And still another such switch arrangement is disclosed in U.S. Pat. No. 4,078,162 issued to John L. Turner on Mar. 7, 1978. The Turner switch utilizes a blade lock that uses a pivotally mounted latch on a remote terminal at the switch jaw which includes a hook-like portion spring biased downwardly into latching position with respect to the end portion of the blade and is rotatable out of latching position by engagement with the latch of an arm carried by the blade when the contact lug is rotated out of engagement with the remote terminal and is formed with an extension engageable with the blade mounted latch operating arm for opening the latch as the blade approaches closed position. Yet another such switch arrangement is disclosed in U.S. Pat. No. 1,695,868 issued to Joseph Stolz on Dec. 18, 1928. The Stolz switch uses an operating mechanism which includes a pair of upright perforated lugs with an inclined face formed on a plate carried by a rotating insulator which engages lugs on a sleeve that surrounds the blade to cause rotation of the blade about its longitudinal axis.

Although the foregoing arrangements are functional there still exists a need and it is therefore an object of this invention to provide an optimized arrangement for rotational movement of the switch blade assembly with respect to its longitudinal axis.

SUMMARY OF THE INVENTION

The present invention provides a double break disconnect switch with a novel drive mechanism. Rotation of the center insulator swings the blade open and closed in a conventional manner but the rotation with respect to its longitudinal axis is unique. This mechanism uses a unique cam to rotate the blade about a hinge axis L. Also the blade bearings are offset from the blade center of gravity so as to use the blade's weight to keep the blade in the position of disengagement with the break jaw contacts when the switch is opened. Also these bearings are very small in diameter which reduces friction to make the switch operate with substantially less force. Since the blade bearings are not around the diameter of the blade, the friction does not increase as current rating increases due to larger blade diameters. Additionally, the camming mechanism is profiled to give maximum rotational torque to the blade as it compresses the contact fingers as the switch closes to its final closed position. A further advantage of the new design is structure that allows the blade to move vertically within pivot points to better align the blade contacts with the break jaw contacts.

The blade is hinged for rotation with a predetermined minimum torque about the longitudinal hinge axis L which is positioned outside the outer surface of the blade and parallel to the longitudinal center axis C of the blade. The hinge axis L is offset from center of gravity W of the blade for initial opening and final closing of the switch.

The cam includes a pivot component attached to the blade, offset from the blade bearings. A blade guide pin cooperates with the blade pivot component. The guide pin has an axis extending parallel to the longitudinal hinge axis L. A drive plate has a vertical plate extension extending from the base portion of the drive plate and includes a slot for carrying the blade guide pin. The vertical plate extension at the slot includes a camming surface for contact by the blade guide pin.

The slot provides a helical course for the blade guide pin to ride on the camming surface. The vertical plate extension is twisted transversely for providing the slot with a predetermined angle and a helical course for the camming surface to minimize the wear between the guide pin and the camming surface.

BRIEF DESCRIPTION OF THE DRAWINGS

For a better understanding of the invention reference may be made to the accompanying drawings exemplary of the invention, in which.

DETAILED DESCRIPTION OF VARIOUS EMBODIMENTS

Figure 1:
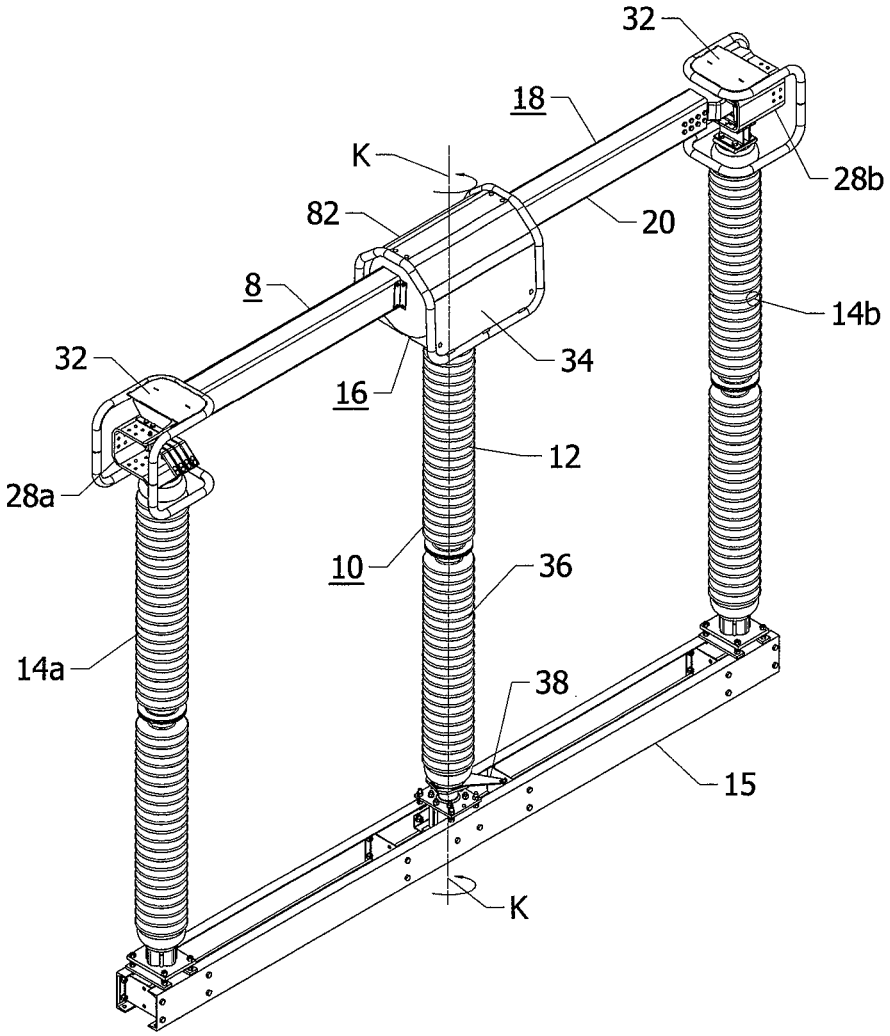
FIG. 1 is a perspective view of a double break disconnect switch of the present invention in the fully closed position.
Figure 2:
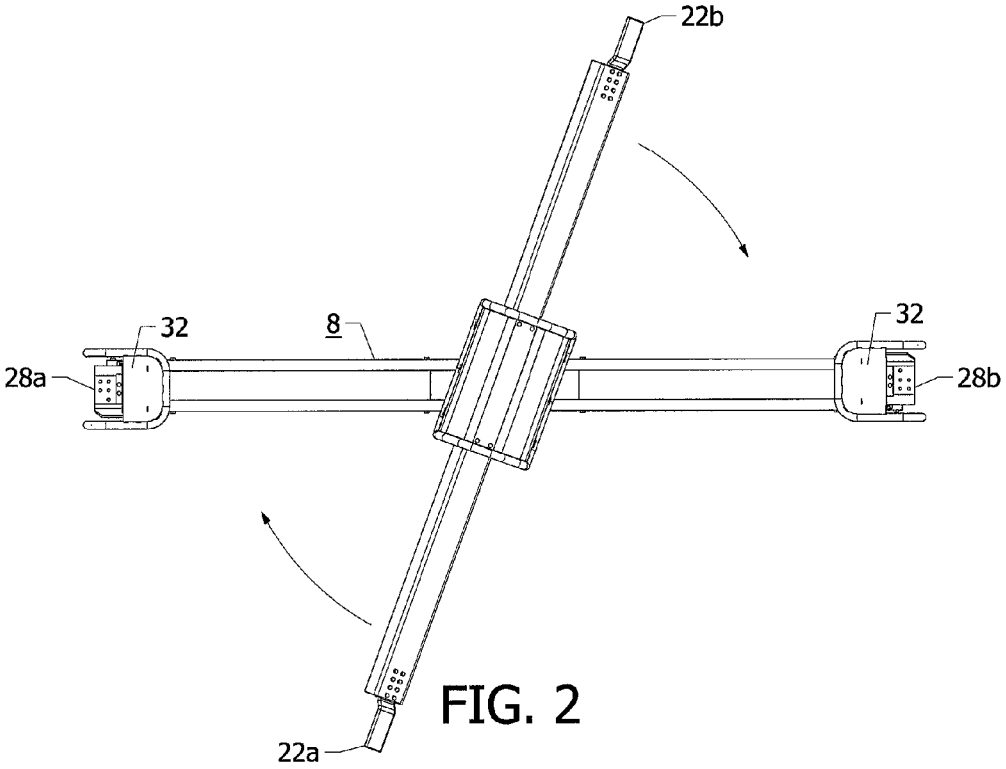
FIG. 2 is a plan view of the switch shown in FIG. 1 with the switch in the fully open position.
Figure 3:
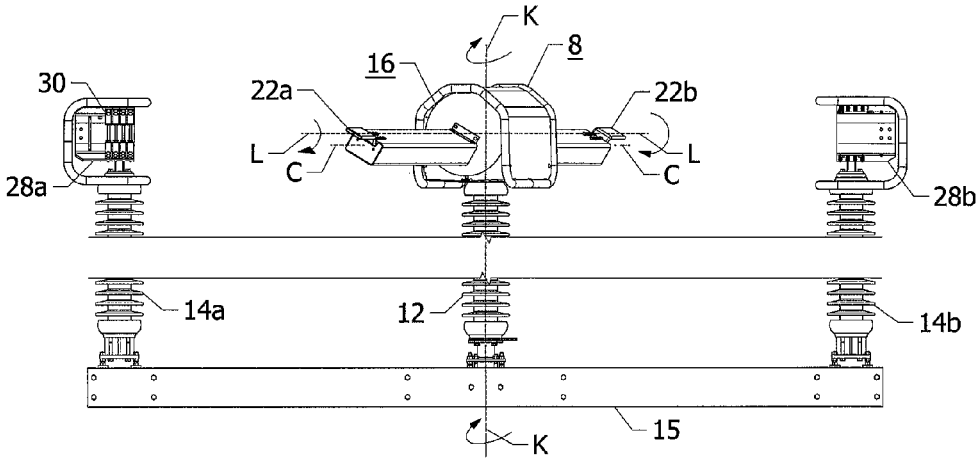
FIG. 3 is an elevation view of the switch shown in FIG. 2.
Figure 4:
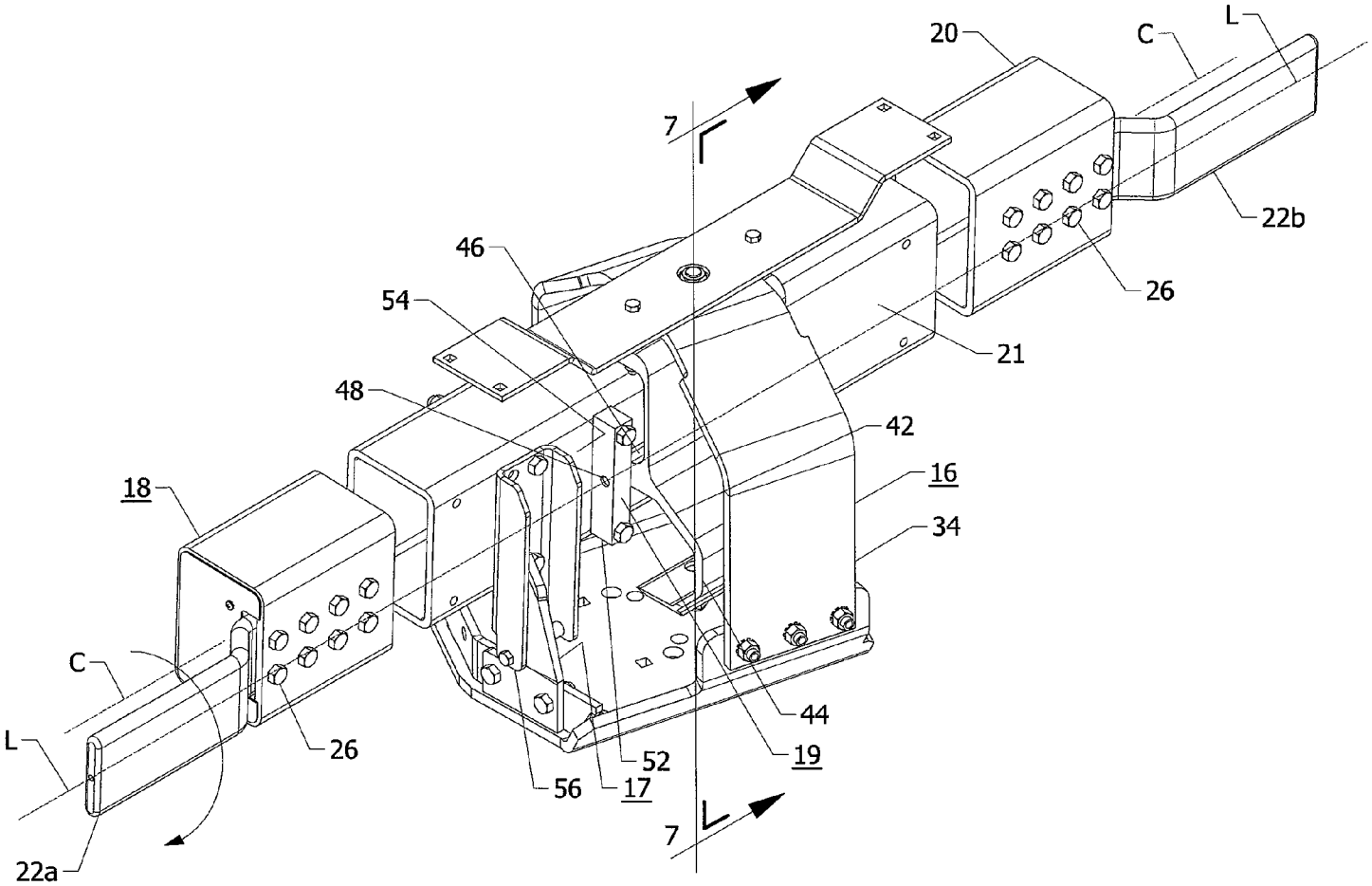
FIG. 4 is a perspective view of the switch blade assembly in the final closed position carried by the bearing arrangement with the weather cap removed.
Figure 5:
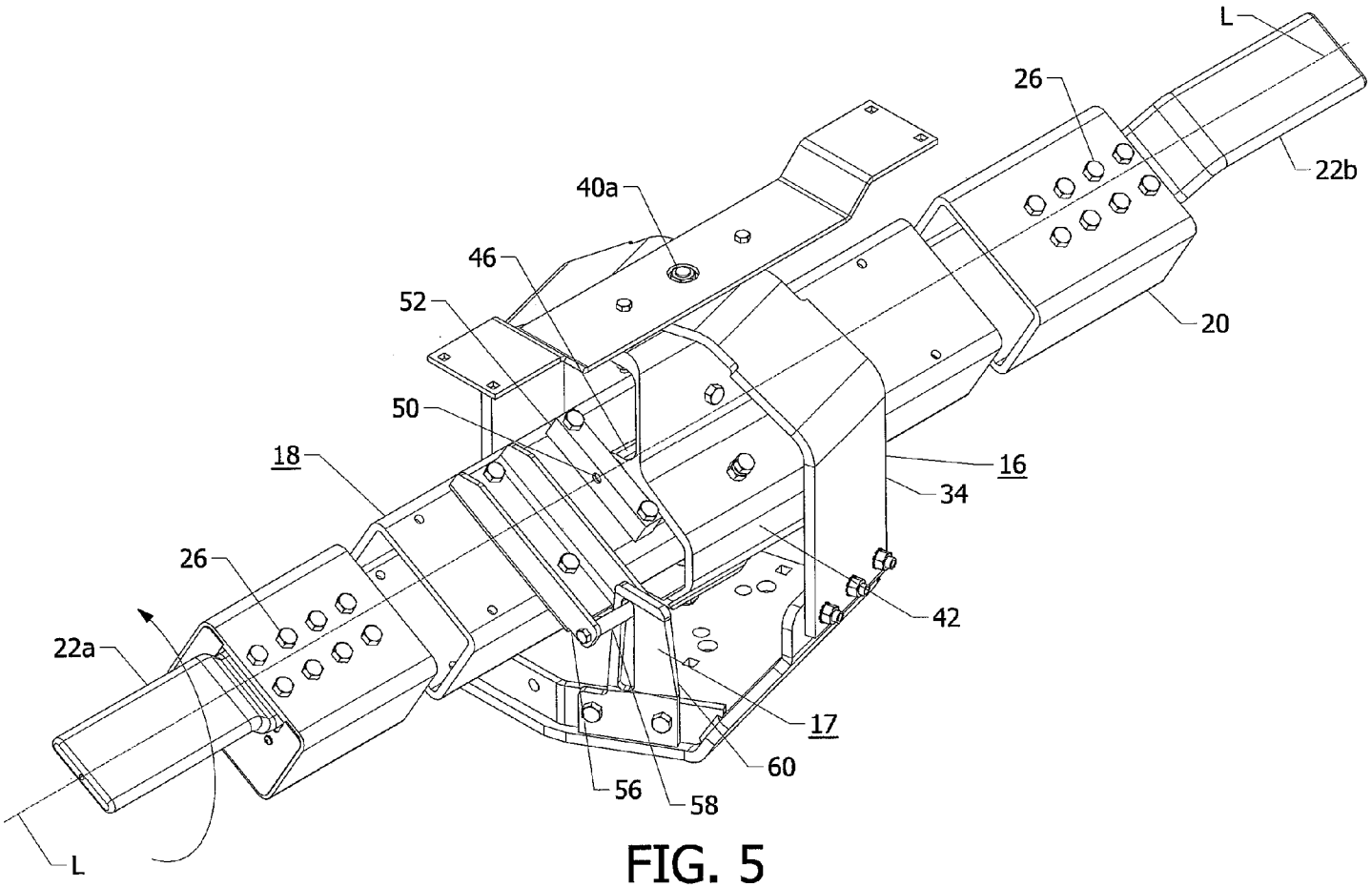
FIG. 5 is a perspective view of the switch blade assembly in the initially open position carried by the bearing arrangement with the weather cap removed.

With reference to FIGS. 1-7, a double break disconnect switch 8 is shown comprising a drive arrangement 10 which includes a rotatable support assembly 36 including center rotatable insulator 12 and fixed insulators 14*a*, 14*b* and a lever 38 mounted to a base member 15. The supporting structure which includes the center rotatable insulator 12 and the fixed insulators 14*a*, 14*b* may be arranged as shown in FIG. 1 or may be in a split V configuration, not shown, for example. A bearing arrangement 16 is mounted on the drive arrangement 10 on the top of the rotatable insulator 12. The drive arrangement 10 is in relative movement relationship with respect to the bearing arrangement 16 via the lever 38. A switch blade assembly 18 includes a tubular switch blade 20 which may have a rectangular shape and be made of aluminum, for example. In FIGS. 4 and 5, the switch blade 20 has contact terminals 22 attached to its ends. The switch blade 20 is heavy and may weigh 120 pounds and be 13 feet in length, for example. The contact terminals 22*a*, 22*b* may have an elongated flattened rectangular shape and may be bent at one end, as shown in FIGS. 4 and 5, and may be made of copper, for example. The switch blade assembly 18 is supported by the bearing arrangement 16 and rotatable about a hinge axis L of the tubular switch blade 20, as shown in FIGS. 4 and 5 and as subsequently described. The contact terminals 22*a*, 22*b* may be attached to the switch blade by a plurality of blade tip bolts 26.

Figure 8:
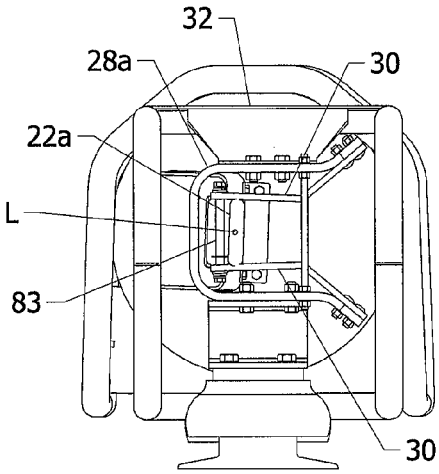
FIG. 8 is a left jaw end elevation view of the switch shown in FIG. 1 showing one of the blade contact terminals in the final closed position.
Figure 9:
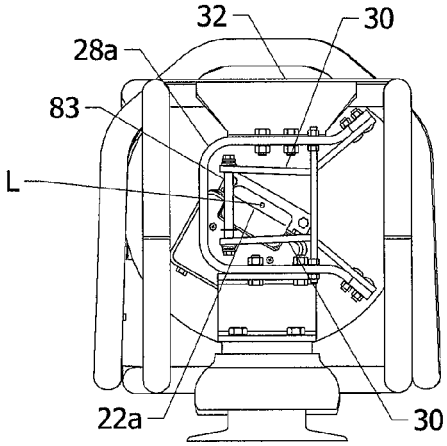
FIG. 9 is same view as FIG. 8 but with the blade rotated to allow the blade to disengage from the jaw contacts; and, FIG. 10 is an elevation view of FIG. 6 showing schematically forces acting on radius A and radius B.

The switch blade assembly 18 is caused to initially open the double break disconnect switch 8 and caused to finally close it with a longitudinal rotation with respect to hinge axis L such as shown in FIGS. 4 and 5. The hinge axis L is offset from the longitudinal axis C of the tubular switch blade 20, as shown in FIG. 4. The switch blade assembly 18 is also arranged for a transverse macro swinging movement about axis K in opposite directions for final opening and initial closing of the double break disconnect switch 8, as shown in FIG. 2. For receiving the contact terminals 22*a*, 22*b* at each end of the tubular switch blade 20, a pair of spaced resilient contact jaws 28*a*, 28*b* is provided for receiving each contact terminal 22*a*, 22*b*, as shown in FIGS. 1, 2, 8 and 9. Each contact terminal 22*a*, 22*b* is engageable with one of the contact jaws 28*a*, 28*b* in a pressure contact relationship during final closing of the switch blade assembly and disengageable from one of the contact jaws 28*a*, 28*b* when the switch blade assembly is initially opened. The switch jaws 28*a*, 28*b* are resilient enough to be spread apart slightly by the contact terminals 22*a*, 22*b* for placing the jaws 28*a*, 28*b* under tension to make good electrical contact. Jaws 28*a*, 28*b* include a plurality of oppositely disposed contacts 30, as shown in FIG. 3, FIG. 8 and FIG. 9. Preferably, covering the jaws 28*a*, 28*b* is an ice shield 32. The jaws 28*a*, 28*b* are securely attached to respective fixed insulators 14*a*, 14*b*, as shown in FIG. 1 and FIG. 3.

The present invention provides that the bearing arrangement 16 includes a switch blade support member 34 mounted on the rotatable support assembly 36 for co-rotatable transverse movement during the transverse macro swinging movement of the switch blade assembly 18, including the switch blade 20, about axis K, as shown in FIG. 1. The bearing arrangement 16 includes a cam means 17 for imparting a rotational movement to the switch blade 20 with respect to hinge axis L. In FIG. 4, the bearing arrangement 16 includes means 19 for hinging the switch blade assembly 18 for rotation of the tubular switch blade 20 about the longitudinal hinge axis L which is offset from the longitudinal center of gravity W of blade assembly 18 for initial opening and final closing of the double break disconnect switch, see FIGS. 4 and 10 for example. Each of the contact terminals 22*a*, 22*b* having a longitudinal axis that is collinear with the hinge axis L and is simply identified as axis L in the Figures. As shown in FIG. 7, the switch blade support member 34 includes upper and lower pivot pins 40*a*, 40*b* for receiving and rotatably supporting a switch blade hinge bracket 42. The switch blade hinge bracket 42 is for rotatably supporting the tubular switch blade 20 proximate the mid-point of the switch blade assembly 18, as shown in FIGS. 4 and 5. The switch blade hinge bracket 42 may have an E-shaped cross-section, such as shown in FIG. 6 and FIG. 7.

Figure 6:
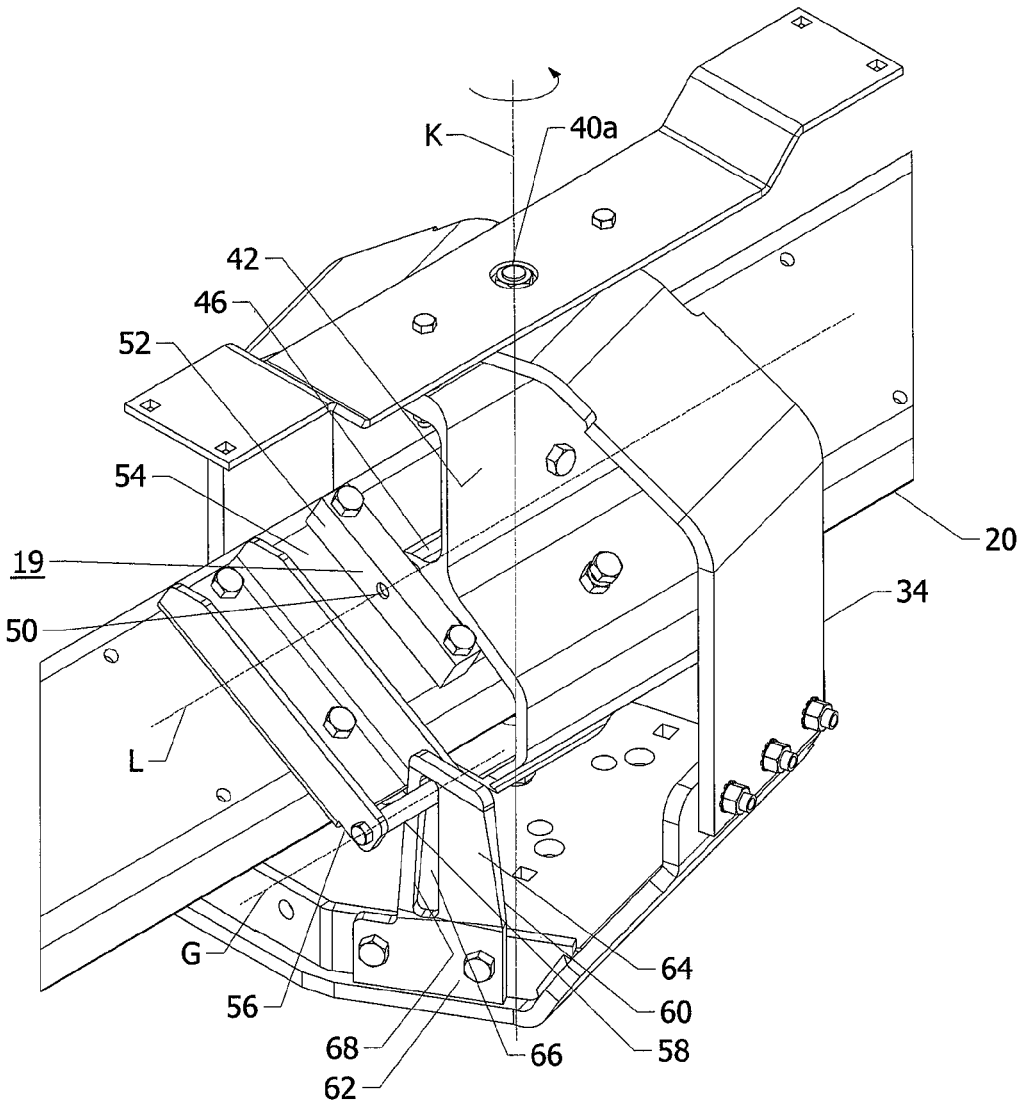
FIG. 6 is an enlarged perspective view of the bearing arrangement of FIG. 5 in operative position.
Figure 7:
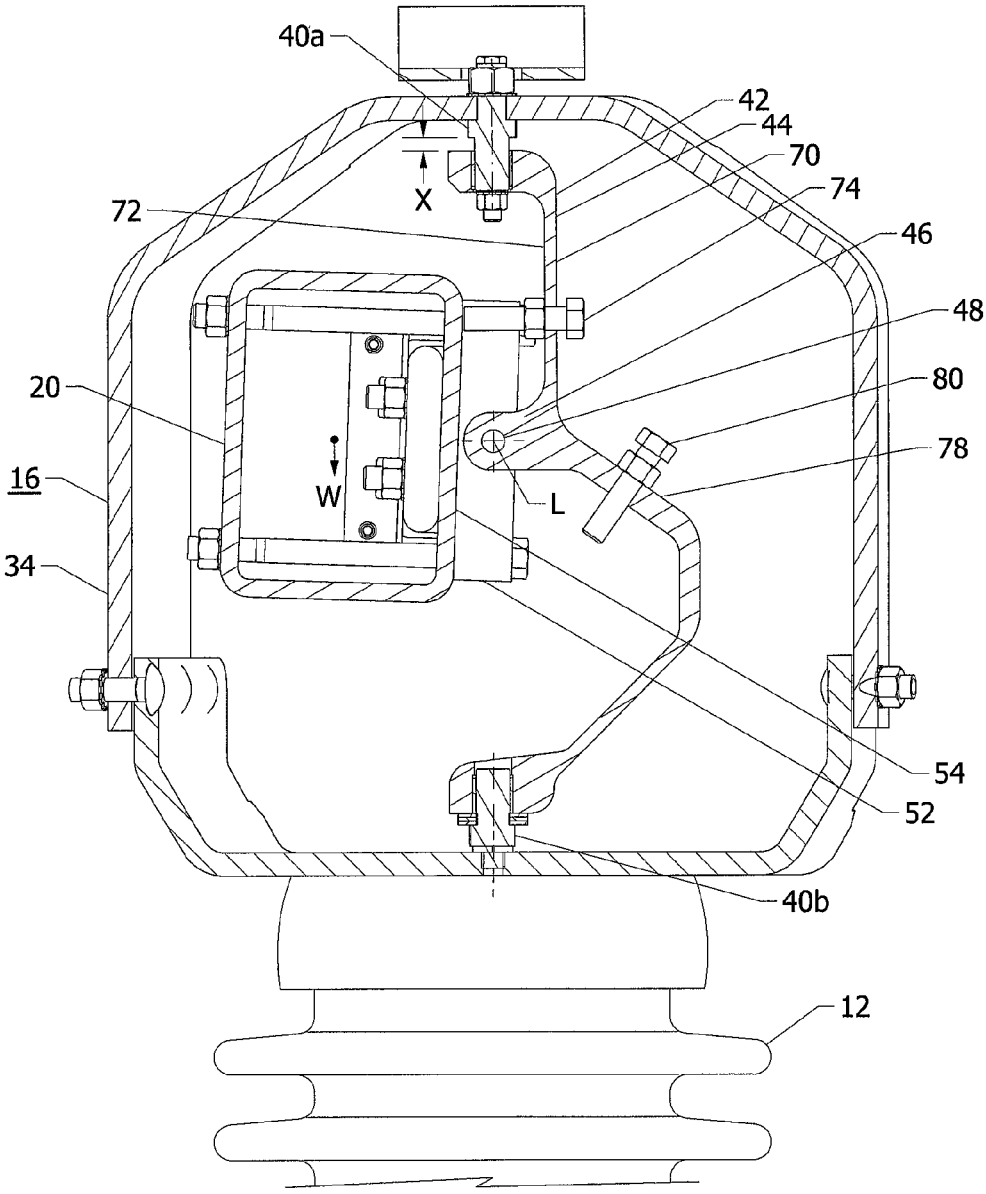
FIG. 7 is a cross section of the bearing arrangement in operative position with the switch in the fully closed position with the weather cap removed taken along the line 7-7 of FIG. 4 mounted on the drive arrangement.

As shown in FIGS. 6 and 7, the switch blade hinge bracket 42 proximate the mid-section 46 of the E-shaped cross-section 44 having an elongated transverse aperture 48 for receiving and holding a rod-shaped bearing 50 of predetermined diameter for supporting the switch blade assembly 18.

At least one switch blade bearing support attachment piece 52 is operably mounted to the rod-shaped bearing 50. The at least one switch blade bearing support attachment piece 52 is affixed to the outer surface 54 of the tubular switch blade 20; thus being offset from the center of gravity W of the tubular switch blade assembly 18 for supporting the tubular switch blade assembly. Most high voltage double break switches employ round tubular blades which rotate on their long i.e., longitudinal axis to achieve the necessary contact pressure developing or relieving ability. This means in most previous designs that the blade must have journal bearings larger in diameter than the blade conductor itself; and in effect encircle the switch blade. Therefore, this means that the frictional drag and the chance of jamming from contaminants increases as blade diameter increases because of the effective area of the journal bearings increasing. The present invention uses an off center bearing location that is independent of the size of the blade therefore the bearing can be much smaller in diameter, thereby greatly reducing the friction and chances of jamming from contamination. The off center location also provides another advantage in that the weight of the blade assembly 18 can now be used to return it to the open position once it is released from its fully closed position. Most if not all current designs require the use of a spring to develop this return to open function. As a blade with large bearings becomes contaminated and difficult to rotate, the spring which may have relaxed over time may not be enough to rotate it to its proper location. Incorrect operation is likely to happen, either incomplete closure and or difficult operation. The present invention using the rod shaped bearing 50 having very small bearing diameters and using unchanging gravitational force, will not suffer this fate. As the current rating of the switch blade increases to 4000 to 5000 amperes, the friction of a very large round diameter blade bearing encircling the blade becomes so high that the switch may not even be operable by manual means. In this situation the present invention is significant.

As shown in FIG. 7, the vertical bearing play of about 0.25 inches to about 0.50 inches at point X between the switch blade support member 34 and the hinge bracket 42 at the pins 40*a* and 40*b* allows the blade 20 to float vertically to seat in the contacts 28*a* and 28*b* equally as the switch closes, as shown in FIG. 3. This permits the blade assembly 18 to float to an equilibrium position vertically to balance the jaw contact 30 forces when the double break disconnect switch 8 is closed. This further advantage of the present invention is the switch blade 20 can "float" to an equilibrium position vertically to balance out the forces on the jaw contacts 30 for optimum life of the contacts 30. An intermediary support member 42 can move up or down as needed to compensate for a switch which that does not have jaws 28*a*, 28*b* in exact alignment with the center insulator 12 and tubular switch blade 20. Previous switch designs with fixed bushing bearings aligning the blade have no ability to allow the blade to float to the equilibrium position which is accomplished in the present invention. Increased operating force, contact wear and possibly compromised short circuit capacity result from misalignment. Increased adjustment time during installation or readjustment during the life of the switch is necessary. The floating blade of the present invention eliminates this concern.

The present invention provides a double break disconnect switch that is easy to install and operate and that will retain its like new operating characteristics for a very long time. As shown in FIG. 6, the novel mechanism for rotating the blade 20 about L axis and axis K is comprised of pivot component 56 attached to blade 20 adjacent attachment piece 52. A blade guide pin 58 is operatively mounted to the switch blade pivot component 56. The blade guide pin 58 having an axis G extending parallel to the hinge axis L. As insulator 12 in FIG. 3 is rotated on axis K to close the switch, the blade drive plate 60, in FIG. 6, pushes on pin 58 to cause blade 20 to also rotate on K axis so as to cause contacts 22*a* and 22*b* to enter jaw contacts 30 until the contacts 22*a*, 22*b* hit spacer 83 shown in FIG. 9. Continued rotation of insulator 12 causes blade 20 to rotate about hinge axis L as the pin 58 slides on the cam surface 68, thereby the blade open position of FIG. 5 is changed to the closed position of FIG. 4 as well as FIG. 3 is changed to FIG. 1.

A blade drive plate 60 including a base portion 62 is attached to the blade support member 34 in predetermined position as shown in FIG. 6, for example. The blade drive plate 60 includes a vertical plate extension portion 64 extending from the base portion 62 of the blade drive plate 60 and having, for example, a slot 66 therein, which may be vertically oriented, for receiving and maintaining the blade guide pin 58 in movable relationship therewith. The vertical plate extension 64 has a camming surface 68 for the blade guide pin 58. The slot 66 provides a helical course for the blade drive pin 58 riding on the camming surface 68. This is a novel cam mechanism of this invention.

Preferably, the vertical plate extension portion 62 is twisted transversely, as shown in FIG. 6, from about 20 degrees to about 30 degrees, for example, for providing the slot 66 with a helical course for the camming surface 68, whereby the pin 58 contacts camming surface 68 squarely as the pin moves top to bottom in the slot 66 as the blade rotates on axis L.

Figure 10:
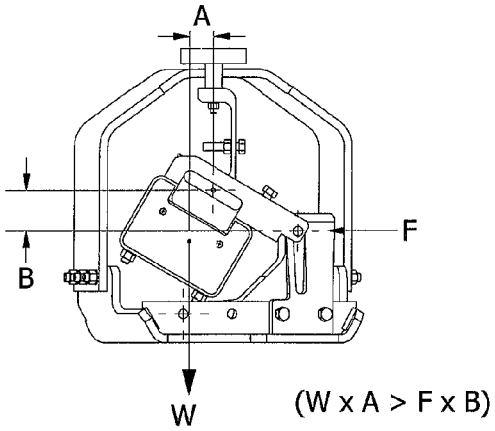

As shown in FIG. 9, for proper closing of the switch it is important that rotation of the blade assembly 18 about axis K be complete up to the point where the contacts 22*a* and 22*b* touch the spacer bumper 83 before any rotation about axis L starts. As rotation about axis K takes place, the weight of the blade assembly 18 pivoting on rod shaped bearing 50 prevents rotation about axis L. Only when the contacts 22*a* and 22*b* engage the spacer bumper 83 does force from the camming surface 68 apply a force to pin 58 which causes the blade assembly 18 to rotate on hinge axis L. Therefore the weight of the blade assembly 18 causes an impedance of rotation about hinge axis L. The optimization of impedance rotation of the switch blade assembly 18 of present invention is dictated by the geometry of the effective lever length of the blade assembly weight pivoting on pin 50 versus the force applied to blade guide pin 58 from cam 68. This is a major difference compared to an approach such as using a beveled gear. The lever and slot concept of this invention allows the blade rotation moment to be optimized to match switch operating requirements. For example, when the switch is open and approaching the initially closed position, the blade contact terminals 22*a*, 22*b* enter into the jaws 28*a*, 28*b* and stop rotating on axis K. Further rotation of the center insulator 12 will start the rotation of the switch blade 20 along hinge axis L. This rotation on hinge axis L needs to be impeded somewhat to guarantee that the blade has fully entered the jaws 28*a*, 28*b* even when ice is present. The impedance to blade longitudinal rotation has been handled in previous designs by complicated linkages and/or springs to overcome the linear load connect that results from using bevel gears, for example. As shown in FIG. 10, the impedance to rotation along the L hinge axis in the present invention is easily accomplished by the weight of the blade assembly W times distance A being greater than pin force F times distance B, i.e., $W \times A > F \times B$. Using the weight of the blade assembly 18 to effect a proper sequence of $1^{st}$ rotation (transverse macro movement) about K and then final rotation about hinge axis L is a critical novel feature.

Once the initial high force to guarantee full engagement into the jaws 28*a*, 28*b* has been met and the hinge axis L rotation begins, it is advantageous to quickly reduce the rotating moment effort need to continue the rotation. In fact, it is now important to be able to develop a mechanical advantage to overcome the large rotational moment encountered when the contact terminals 22*a*, 22*b* begin to engage. This again is easily accomplished by the location of the slot 66 relative to the driven pin 58. Previous designs with bevel gears and linear output cannot increase the mechanical advantage to lower the operating force as does the cam surface 68 which effectively changes the lever length B as pin 58 travels in the slot 66. Distance "B" grows as the blade rotates, thereby reducing the force "F" needed to overcome the increasing frictional force created from the engaging contacts, i.e., contact terminals 22*a*, 22*b* engaging jaw contacts 30.

Referring to FIG. 7, the switch blade hinge bracket 42 includes at an upper portion 70 of the E-shaped cross-section 44 a substantially vertical wall 72. A first switch blade stop bolt 74 is affixed to the vertical wall 72 for preventing further rotation of the tubular switch blade 20 when the blade is fully closed. The switch blade hinge bracket 42 includes at a lower portion 78 of the E-shaped cross-section 44 a second switch blade stop bolt 80 is attached to the lower portion 78 for preventing further rotation of the tubular switch blade when the blade is fully opened. The switch blade hinge bracket 42 is in pivotable arrangement with respect to the switch blade support member 34 for permitting rotation of the switch blade about the hinge axis L as force is applied to the blade guide pin 58.

Preferably, a weather cap 82 is affixed to the top of the switch blade support member 34 for protecting the bearing arrangement against environmental elements.

Of course variations from the foregoing embodiments are possible without departing from the scope of the invention.

What is claimed is:

1. In combination with a double break disconnect switch comprising a drive arrangement including a rotatable support assembly including at least one rotatable insulator and a lever for imparting rotation to the at least one rotatable insulator, a bearing arrangement mounted on the drive arrangement, said drive arrangement via the lever in relative movement relationship with respect to the bearing arrangement, a switch blade assembly including a switch blade supported by the bearing arrangement and rotatable with respect to the longitudinal axis thereof for initial opening of the double break disconnect switch and for final closing of the double break disconnect switch and the switch blade assembly arranged for a transverse swinging movement for final opening and initial closing of the double break disconnect switch, a contact terminal affixed at each end of said switch blade, a pair of spaced resilient contact jaws for receiving each contact terminal, each contact terminal engageable with one of the contact jaws in a pressure contact relationship during final closing of the switch blade assembly and disengageable from one of the contact jaws when the switch blade assembly is initially opened, the improvement which comprises:

the bearing arrangement including means for hinging the switch blade assembly for rotation of the switch blade with a predetermined minimum torque about a hinge axis positioned outside the outer surface of the switch blade and parallel to the longitudinal center axis of the switch blade and offset from the center of gravity of the switch blade assembly for initial opening of the double break disconnect switch and for final closing of the double break disconnect switch, the bearing arrangement including a switch blade support member mounted on the rotatable support assembly for co-rotatable transverse movement therewith during the transverse swinging movement of the switch blade, the bearing arrangement including a cam means for imparting the transverse swinging movement to the switch blade assembly and for imparting a rotational movement thereto with respect to the hinge axis of the switch blade during final closing or initial opening of the double break disconnect switch, each of the contact terminals having a longitudinal axis that is collinear with the hinge axis.

2. The combination of claim 1, wherein the means for hinging the switch blade assembly for rotation of the blade about the hinge axis of the switch blade comprises:

the switch blade support member including upper and lower vertical pivot pins for receiving and rotatably supporting a switch blade hinge bracket therebetween, the switch blade hinge bracket proximate the mid-section thereof having an elongated transverse aperture for receiving and holding a relatively small diameter rod-shaped bearing for supporting the switch blade assembly, at least one switch blade bearing support attachment piece operably mounted to the rod-shaped bearing, the at least one switch blade bearing support attachment piece affixed to the outer surface of the switch blade for supporting the tubular switch blade.

3. The combination of claim 2, wherein the cam means comprises:

a switch blade pivot component affixed to the switch blade in predetermined position offset from the at least one switch blade bearing support attachment piece, a blade guide pin operatively mounted to the switch blade pivot component, the blade guide pin having an axis extending parallel to the longitudinal axis of the switch blade, a blade drive plate including a base portion affixed to the blade support member in predetermined position, the blade drive plate including a slot therein for receiving and maintaining the blade guide pin in movable relationship therewith, the slot including a camming surface for the blade guide pin.

4. The combination of claim 3, wherein the slot is for providing a helical course for the blade drive pin riding on the camming surface.

5. The combination of claim 4, wherein the slot is twisted transversely for providing the slot with predetermined angle and helical course for the camming surface, whereby the wear between the blade guide pin and camming surface is minimized.

6. The combination of claim 1, wherein the predetermined minimum torque to rotate the switch blade about the hinge axis offset from the switch blade assembly center of gravity is greater than the torque to rotate the switch blade assembly transversely about the rotating insulator axis, thereby providing an impedance to rotation of the switch blade assembly with respect to the hinge axis for ensuring that the blade contact terminals fully enter the jaw contacts before rotation of the switch blade into full connection with the jaw contacts.

7. The combination of claim 2, wherein the blade support member is dimensioned to allow vertical movement of the hinge bracket at the pivot pins, thereby permitting the blade assembly to float to an equilibrium position vertically to balance contact forces between the blade contact terminals and the jaw contacts.

8. The combination of claim 2, wherein the rod-shaped bearing has a diameter of from about 0.5 inches to about 1.0 inches, thereby reducing friction.

9. The combination of claim 2, wherein the switch blade hinge bracket includes a first switch blade stop bolt to control the final close rotation of the switch blade and a second blade stop bolt to control the final open rotation of the switch blade with respect to its longitudinal axis.

10. The combination of claim 6, wherein the camming surface is dimensioned to provide greater torque for rotation of the switch blade assembly during final closing of the disconnect switch.

11. The combination of claim 1, further comprising a weather cap affixed to the top of the switch blade support for protecting the bearing arrangement against environmental elements and excluding the nesting of birds.

12. The combination of claim 7, wherein the switch blade hinge bracket is permitted to float with respect to its vertical axis from about 0.25 inches to about 0.50 inches.

13. The combination of claim 3, wherein each of the resilient contact jaws includes a spacer bumper for contacting one of the contact terminals for initiating the camming surface to apply a force to the blade guide pin for causing the switch blade rotation about the hinge axis.

14. The combination of claim 13, wherein the switch blade hinge bracket is in pivotable arrangement with respect to the switch blade support member for permitting rotation of the switch blade about the hinge axis as force is applied to the blade guide pin.

15. The combination of claim 14, wherein during final closing of the disconnect switch the vertical distance between two horizontal imaginary lines, one of said horizontal imaginary lines passing through the hinge axis and the other of said horizontal imaginary lines passing through the guide pin axis, grows as the blade rotates thereby reducing the force needed to overcome the increasing frictional force created from the engagement of the contact terminals and contact jaws.

* * * * *